United States Patent [19]

McDuff et al.

[11] Patent Number: 4,569,303

[45] Date of Patent: Feb. 11, 1986

[54] SHIP FLUID CARGO SALVAGE DIAPER

[76] Inventors: George L. McDuff; Bobby G. McCoy, both of 308 E. Vindine, both of Sulphur, La. 70663

[21] Appl. No.: 655,059

[22] Filed: Sep. 27, 1984

[51] Int. Cl.[4] ..... B63C 11/52

[52] U.S. Cl. ..... 114/227; 114/229; 405/188

[58] Field of Search ..... 114/227, 229, 343, 345, 114/361, 223, 322, 336; 405/11, 185–188

[56] References Cited

U.S. PATENT DOCUMENTS

| | | | |
|---|---|---|---|
| 2,446,190 | 8/1948 | Oding | 114/227 |
| 3,329,121 | 7/1967 | Ulrich | 114/227 |
| 3,857,249 | 12/1974 | Kelly | 114/227 |
| 4,175,510 | 11/1979 | Devine | 114/227 |
| 4,362,437 | 12/1982 | Leary | 114/227 |

FOREIGN PATENT DOCUMENTS

| | | | |
|---|---|---|---|
| 1221773 | 2/1971 | United Kingdom | 114/227 |

*Primary Examiner*—Trygve M. Blix
*Assistant Examiner*—C. T. Bartz
*Attorney, Agent, or Firm*—Warren H. Kintzinger

[57] ABSTRACT

A lipped mouth structure with lips engaging the side of a ship such as an oil tanker around an area of puncture or rupture with a flexible diaper container fastened to the lips and extended outward therefrom. The lip structure has transverse cross brace bars retained in molded pockets of the lip structure with the lips in the form of inflatable rings of rubber (synthetic rubber or rubber like plastic) having a soft pliable surface engaging the side of a ship. Vertically oriented straps with "D" rings at their opposite ends are provided for tying the straps and the lip structure in place on the side of a damaged ship with cables attached to the "D" rings. The flexible diaper container is supported by floats spaced strategically along the length thereof to support the diaper container in its extension along the surface of the water while flexing with wave action of the sea. A float also supports a suction pipe section extending into the interior of the diaper container, suction pipe connectors and valves along with air line and valve equipment for feeding air to the inflatable lips.

16 Claims, 6 Drawing Figures

SHIP FLUID CARGO SALVAGE DIAPER

Figures 1, 2:
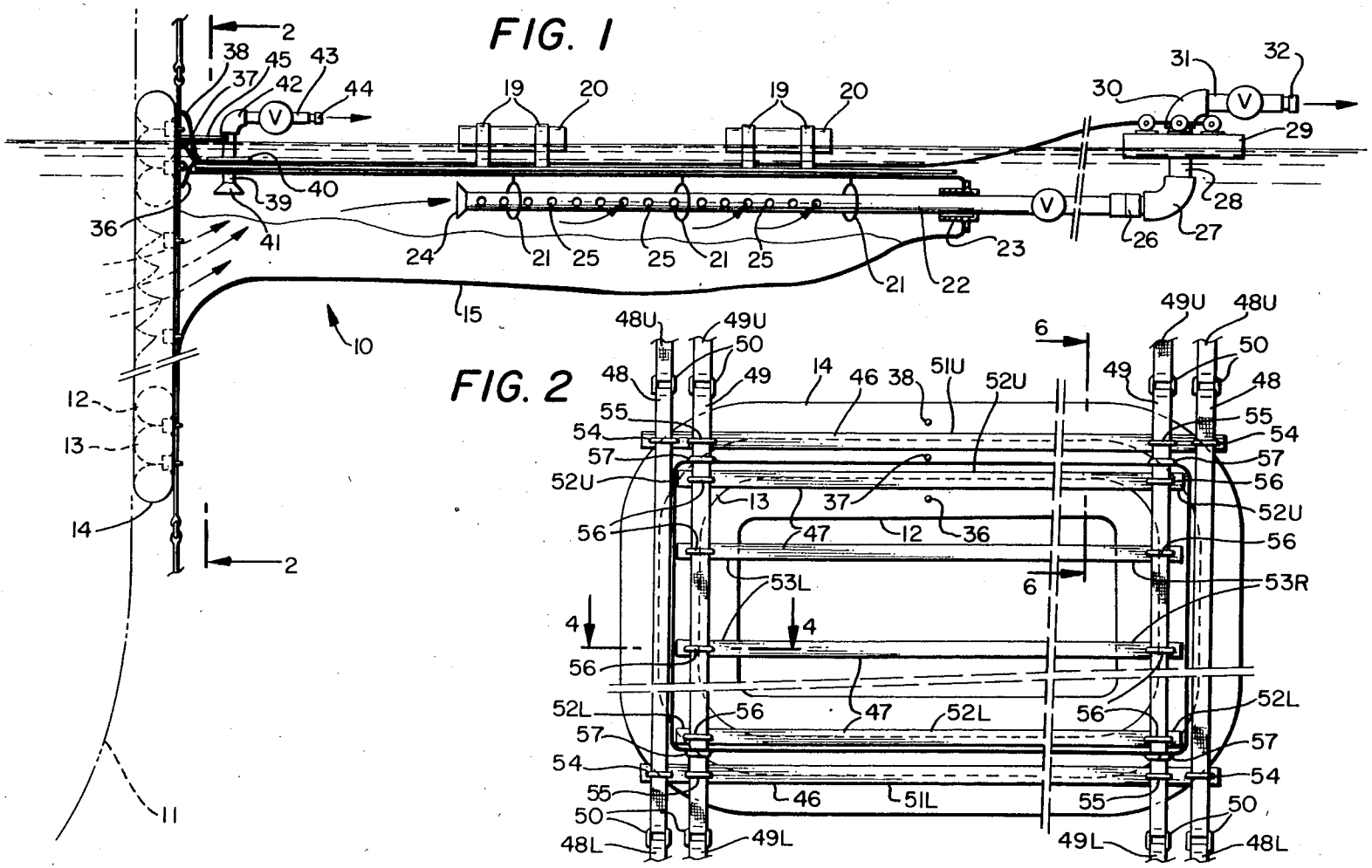

This invention relates in general to ship cargo salvage equipment and devices, and more particularly, to a ship fluid cargo salvage diaper quite useful in salvaging crude oil or refined petroleum products leaking from a ruptured ship.

Loaded tanker ships on the high seas occasionally encounter trouble, collision between ships, deep draft heavily loaded tankers with underwater channel obstancles, and running aground with rupture tears and holes being punched in the vessels such as to cause leakage. Such petroleum leakage can be quite costly not only in product lost but also in contamination of sea waters, beaches and marsh lands and is severely damaging to sea life. Further, leakage of oil and petroleum products can constitute a severe fire hazard leading with explosions to destruction of some vessels and loss of life. The disastrous consequences of such accidents can be minimized or eliminated through effective containment and recovery of such products leaking from a damaged ship.

It is therefore a principal object of this invention to salvage fluid cargo leaking from a ruptured ship.

Another object is to prevent contamination of the sea, beaches, marh lands and harm to sea life.

A further object is to minimize the danger of fire and explosions with leaking inflammable fluids.

Still another object is to minimize the hazards to sea vessel navigation and travel.

Features of the invention useful in accomplishing the above objects include, in a ship fluid cargo salvage diaper for ruptured tankers, a multilipped mouthed structure with flexible inflatable lips held in engagement with the side of a ship such as an oil tanker around an area of vessel wall puncture or rupture with the salvage diaper including a flexible diaper container fastened to the lips and extended outward therefrom. The lip structure has transverse cross brace bars retained in molded pockets of the lip structure with the lips in the form of inflatable rings of rubber (synthetic rubber or rubber like plastic) having a soft pliable surface engaging the side of a ship. Vertically oriented straps with "D" rings at their opposite ends are provided for tying the straps and the lip structure in place on the side of a damaged ship with cables attached to the "D" rings. The flexible diaper container is supported by floats spaced strategically along the length thereof to support the diaper container in its extension along the surface of the water while flexing with wave action of the sea. A long plank like yet flexible member extends along the top of the flexible diaper container in an extended state capable of flexing to some degree with wave action on the floats connected thereto and on the diaper container itself. A float also supports a suction pipe section extended into the interior of the diaper container, suction pipe connectors and valves along with air line and valve equipment for feeding air to the inflatable lips.

A specific embodiment representing what is presently regarded as the best mode of carrying out the invention is illustrated in the accompanying drawings.

Figure 3:
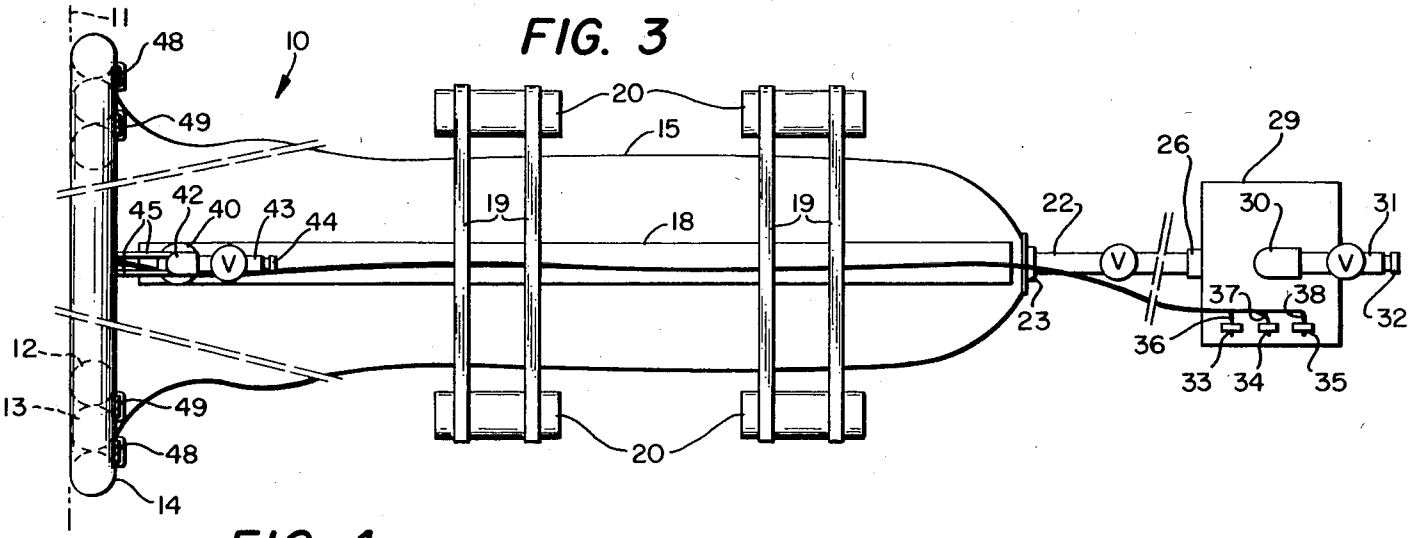
Figure 5:
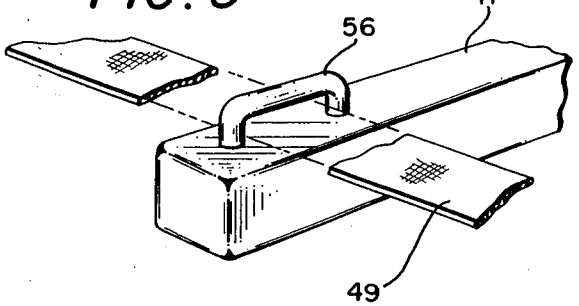
Figure 4:
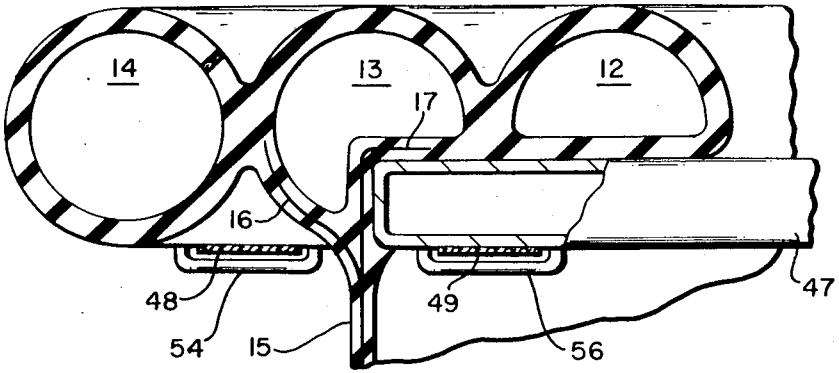
Figure 6:
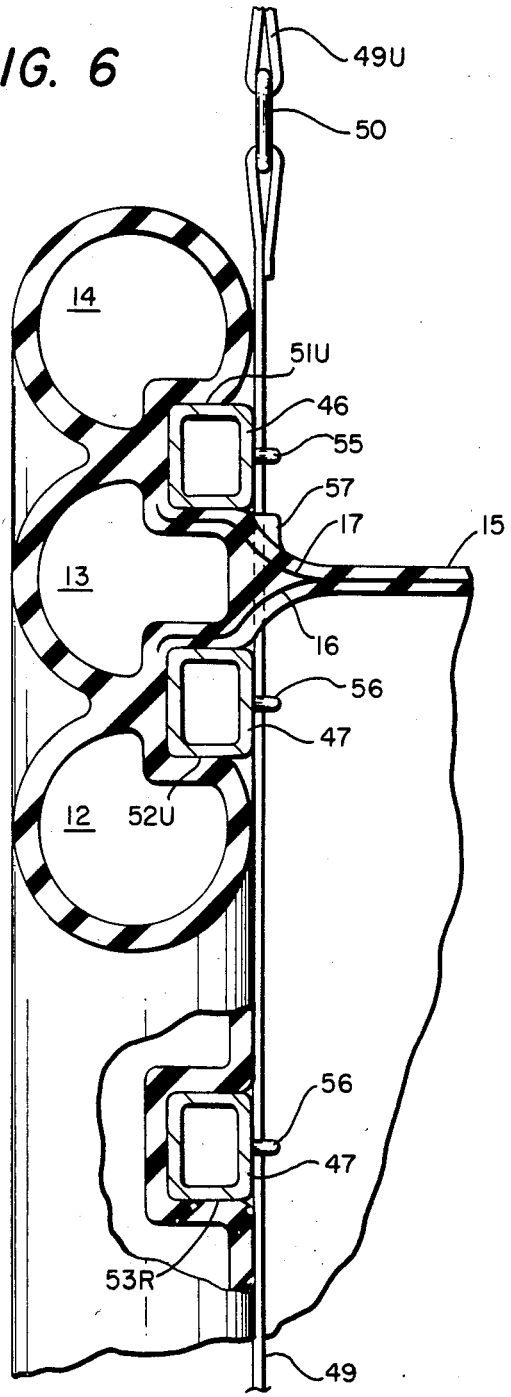

In the drawings:

FIG. 1 represents a side elevation view of applicant's ship fluid cargo salvage diaper;

FIG. 2, a partially cut away view of salvage diaper detail taken along line 2—2 of FIG. 1;

FIG. 3, a top plan view of the ship fluid cargo salvage diaper of FIG. 1;

FIG. 4, a partially cut away and sectioned view showing structure detail of the salvage diaper taken along line 4—4 of FIG. 2;

FIG. 5, a partial detail perspective view of a cross brace bar and a hold down strap used for holding the diaper structure in place on a ship; and FIG. 6, a partial cut away and sectioned view showing additional structural detail of the salvage diaper taken generally along line 6—6 of FIG. 2.

Referring to the drawings:

The ship fluid cargo salvage diaper 10 of FIGS. 1—6 is shown generally in its mounted state held on its side of a ship 11 around a leaking rupture hole and extending into the sea. The mounting face or mouth of the diaper structure includes three side by side joined inflatable generally rectangular rings 12, 13 and 14 generally in concentric relation that while flexible in adapting to any curves or irregularities in the side of a ship they lend lateral support one to the other. A flexible diaper container 15 is fastened to the center ring 13 as by ply extensions 16 and 17 thereof being bond cured to the ring 13 that along with rings 12 and 14 are made of a flexible rubber, synthetic rubber or plastic material selected for suitability to the job. The flexible diaper container 15 is held in a generally extended state when in place in the sea by a plank 18 of relatively stiff yet flexible plastic material that is fastened to the top of diaper container 15. The plank 18 that can flex with wave action is connected to float cross frame members 19 mounting floats 20 of light material such as foamed plastic. The plank 18 is also provided with spaced support rings 21 fastened thereto that extend down in the interior of diaper container 15 to support and limit relative movement of product suction pipe 22 that extends well into the diaper container 15 through a slip sleeve 23 in the outer end of the container 15. The suction pipe 22 is provided with flared open end 24 and with perforation holes 25 along a portion of its length within the diaper container 15. Outside of the slip sleeve 23 suction pipe 22 extends to swivel connector 26 that includes a quick coupler at right angle elbow 27 for pipe 28 extension up through float 29 (also formed of foamed plastic) to elbow 30 with a pipe 31 extension to quick disconnect coupling 32. Three air line connectors 33, 34 and 35 with gauges are also carried on float 29 for air lines 36, 37 and 38 that extend therefrom over plank 18 to, respectively, rectangular rings 12, 13 and 14.

A relatively small suction pipe 39 is mounted by a flange 40 on the plank 18 to extend through the plank 18 to a bottom flared open end 41 within the diaper container 15 closely adjacent to rings 12, 13, and 14 defining the mounting face or mouth of the diaper structure. The pipe 39 extends upward to a right angled elbow 42 from which pipe 43 extends to quick disconnect coupling 44. A brace structure 45 extends from ring 13 to pipe 39 as a support aid to the suction pipe structure.

Referring again in greater detail to the lipped mouth structure with the three side by side joined generally rectangular rings 12, 13 and 14 both transverse horizontal and vertical stability and structural integrating are important in attaining the enclosure reliability desired around a leaking rupture opening in the side of a ship such as an oil tanker 11. Lateral stability and structural integrity are attained through use of transverse cross brace bars 46 and 47 and vertical stability and structural integrity are attained through use of straps 48 and 49 that extend through and beyond the vertical length of the lipped mouth structure to connector rings 50 at opposite ends thereof. While these are shown as being connected to strap extensions 48U, 48L, and 49U and 49L, respectively, the connector rings could be "D" rings connected to cables holding the lipped mouth structure of the ship fluid cargo salvage diaper 10 in place against the side of a ship at the location needed. Obviously, the salvage diapers 10 would be available in a great range of sizes both in horizontal width and in vertical length to accommodate a considerable range of ship side rupture openings and location of openings. In any event strap extensions 48U and 49U as upper strap extensions would be run up to the deck of the ship 11 on the side of rupture opening the salvage diaper 10 is used for, and strap extension 48L and 49L as lower strap extensions would be run down under the ship and back up the other side of the ship to the deck on the other side. When cables are used in place of strap extensions 48U and 49U and/or 48L and 49L "D" rings would be used in place of connector rings 50.

Both the upper and lower transverse cross brace bars 46 are seated in molded upper and lower pockets 51U and 51L molded in the outer facing diaper container 15 facing side of the lipped mouth structure between rings 13 and 14 as shown for the upper cross brace bar 46 in FIG. 6, and with the pockets 51U and 51L extended on through ring 14 at the rounded corners thereof as shown in FIG. 2. Within the confines of the salvage diaper container 15 the uppermost and lowermost cross brace bars 47 are seated in molded upper and lower pockets 52U and 52L molded in the lipped mouth structure between rings 12 and 13 as shown for the upper cross brace bar 47 in FIG. 6 and with the pockets 52U and 52L extended on through line 13 and partially into ring 14 at the rounded corners thereof as shown in FIG. 2. Additional cross brace bars 47 are employed at strategically spaced intervals between the uppermost and lowermost bars 47 varying from one to many depending on the vertical length of the lipped mouth structure of the ship fluid cargo salvage diaper 10 with opposite ends of the intermediate bars 47 extended into and seated in opposite end molded pockets 53L and 53R in ring 12 as shown in FIG. 6 that extend on partially into ring 13 as shown in FIGS. 2 and 4. The cross brace bars 46 and 47 aid in restraining the inflated lips 12, 13, and 14 while flexible and conforming to a ship side they are held against from folding in on themselves or collapsing toward each other with the sea forces imposed on the overall salvage diaper structure.

The vertically oriented straps 48 are passed over the outer diaper container 15 side of the lipped structure generally in line with the opposite side junctions of lips 13 and 14 and extend through strap eye braces 54 on opposite ends of both cross brace bars 46. Inboard and parallel thereto vertically oriented straps 49 are passed over the outer diaper container side of the lipped structure generally in line with the opposite side junctions of lips 12 and 13 and extends through strap eye braces 55 positioned inwardly from strap eye braces 54 on both cross brace bars 46. Straps 49 are also passed through strap eye braces 56 on opposite ends of intermediate bars 47, and in passing from the interior to the exterior of the diaper container 15 they are passed through molded slot shoulders 57 as shown in FIGS. 2 and 6. With lips 12, 13 and 14 inflated to an adequate proper pressure and straps 48 and 49 tensioned in holding the lipped structure against the side of ship 11 the lips 12, 13 and 14 are additionally restrained from folding in on themselves or collapsing toward each other with the sea forces imposed on the overall salvage diaper structure.

It should be noted that the ply extensions 16 and 17 from diaper container 15 ply 58 fall into different mold conformed shapes as shown in FIGS. 4 and 6 as dictated by various structural requirements. Further, tie lines extended from the ship to the float structures including floats 20 and float 29 (tie line structure not shown) to limit sidewise displacement of the diaper container 15 from desired alignment with the lipped mouth structure. The overall structure is relatively light and relatively easy to handle in its collapsed state and lends itself to relatively convenient installation over a ruptured hole damaged area of a ship.

Whereas this invention has been described with respect to a single embodiment thereof, it should be realized that various changes may be made without departure from the essential contributions to the art made by the teachings hereof.

We claim:

1. A ship fluid cargo containment and salvage structure mountable about a leaking ruptured opening in the side of a ship comprising: a plurality of side by side interconnected inflatable concentric hollow rings of resiliently flexible material about a center opening as a lipped mouth structure configured for engaging the side of a ship around a ruptured opening; cross brace means seated on said lipped mouth structure; strap means extended over the side of said lipped mouth structure remote from the side thereof that engages the side of a ship; a fluid cargo containment flexible material walled enclosure having an open end connected to a ring of said lipped mouth structure so as to receive and contain fluid cargo leaking from a rupture opening in the side of a ship; suction pipe means extended into said cargo containment flexible material walled enclosure; and float means for supporting said enclosure and said suction pipe means; wherein said cross brace means are a plurality of generally horizontally extended cross braces when said lipped mouth structure is held against the side of a ship; said strap means is generally vertically extended when holding said lipped mouth structure against the side of a ship; said strap means is a plurality of straps with straps connected with opposite ends of said cross braces; with strap eye braces being the means connecting straps with the cross braces; and with straps overlying the ends of said cross braces; and wherein molded pockets are provided in said lipped mouth structure that fit and provide seating receptacle pockets for respective cross braces; and with cross braces seated in said molded pockets of the lipped mouth structure.

2. The ship fluid cargo containment and salvage structure of claim 1, wherein said plurality of side by side interconnected inflatable concentric hollow rings are molded to generally a rectangular shape with the innermost and smallest ring defining a generally rectangular opening as said center opening and with each of successively larger rings interconnected with the next adjacent inner ring; and with the generally rectangular shape of said rings including rounded corners.

3. The ship fluid cargo containment and salvage structure of claim 2, wherein said plurality of side by side interconnected inflatable concentric hollow rings are each generally circular in transverse section; and with independent inflation means for each of the plurality of said rings.

4. The ship fluid cargo containment and salvage structure of claim 3, wherein the uppermost and lowermost of said cross braces are seated in molded pockets of the lipped mouth structure throughout substantially their entire length and are coexistent, respectively, with the upper and lower portions of the rectangular shape of said lipped mouth structure.

5. The ship fluid cargon containment and salvage structure of claim 4, wherein the cross braces adjacent to and inboard from the uppermost and lowermost cross braces are also seated in molded pockets of the lipped mouth structure throughout substantially their entire lengths and are also coexistent respectively with the upper and lower portions of the rectangular shape of said lipped mouth structure.

6. The ship fluid cargo containment and salvage structure of claim 5, wherein the plurality of straps of said strap means includes four generally parallel straps, two overlying the left side portion of the rectangular shape of said lipped mouth structure and two overlying the right side portion of the rectangular shape of said lipped mouth structure.

7. The ship fluid cargo containment and salvage structure of claim 6, wherein the outermost strap of each side overlies the respective outer ends of said uppermost and said lowermost braces and extends through strap eye braces on said uppermost and said lowermost braces.

8. The ship fluid cargo containment and salvage structure of claim 7, wherein the innermost strap of each side overlies said uppermost and said lowermost braces and also cross braces inboard from said uppermost and said lowermost braces and extend through strap eye braces on said cross braces.

9. The ship fluid cargo containment and salvage structure of claim 8, wherein a plurality of cross braces span the mouth opening of said lipped mouth structure and are seated in pockets provided therefore in the opposite side portions of said lipped mouth structure.

10. The ship fluid cargo containment and salvage structure of claim 8, wherein the innermost strap of both sides overlies the respective ends of said plurality of cross braces spanning the mouth opening of said lipped mouth structure and extend through strap eye braces on said plurality of cross braces.

11. The ship fluid cargo containment and salvage structure of claim 10, wherein said fluid cargo containment flexible material walled enclosure generally encloses within the confines of the open mouth thereof the cross braces of said structure between said uppermost and said lowermost cross braces.

12. The ship fluid cargo containment and salvage structure of claim 11, wherein said innermost strap of each side extends from the exterior to the interior and back to the exterior of said fluid cargo containment flexible material walled enclosure.

13. The ship fluid cargo containment and salvage structure of claim 12, wherein entrance and exit of said innermost straps from and to the interior to the exterior of said fluid cargo containment flexible walled enclosure is through molded slots provided therefore.

14. The ship fluid cargo containment and salvage structure of claim 13, wherein said plurality of side by side interconnected inflatable concentric hollow rings is three rings with said fluid cargo containment flexible material walled enclosure connected by a bonded interconnection to the middle ring of said three rings.

15. The ship fluid cargo containment and salvage structure of claim 1, wherein a relatively stiff yet flexible material plank is fastened to the top of said fluid cargo containment flexible material walled enclosure and also to said float means for supporting said enclosure; and with said suction pipe means including a suction pipe extended into said closure through slip sleeve means at the outer end of said enclosure; and float means supporting said suction pipe and connective pipe extensions thereof outside of said enclosure.

16. The ship fluid cargo containment and salvage structure of claim 15, wherein an additional suction pipe mounted on said plank and on said lipped mouth structure extends vertically from above through the top of said enclosure to the interior of said enclosure.

* * * * *